US007101808B2

(12) United States Patent
Tucker et al.

(10) Patent No.: US 7,101,808 B2
(45) Date of Patent: Sep. 5, 2006

(54) CHROMATE-FREE METHOD FOR SURFACE ETCHING OF STAINLESS STEEL

(75) Inventors: Wayne C. Tucker, Exeter, RI (US); Maria G. Medeiros, Bristol, RI (US); Richard Brown, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 570 days.

(21) Appl. No.: 10/679,683

(22) Filed: Oct. 6, 2003

(65) Prior Publication Data

US 2004/0180799 A1 Sep. 16, 2004

Related U.S. Application Data

(62) Division of application No. 10/143,173, filed on May 7, 2002, now Pat. No. 6,706,207.

(51) Int. Cl.
*H01L 21/302* (2006.01)
*C09K 13/00* (2006.01)
*C09K 13/06* (2006.01)

(52) U.S. Cl. ..... 438/745; 252/79.1; 252/79.4

(58) Field of Classification Search ..... 438/745; 252/79.1, 79.4
See application file for complete search history.

(56) References Cited

U.S. PATENT DOCUMENTS 2,790,738 A * 4/1957 Alexander et al. ..... 134/2
3,145,178 A * 8/1964 Boettner et al. ..... 510/245
5,073,589 A * 12/1991 Milovich et al. ..... 524/439

OTHER PUBLICATIONS

Search on Google, MSDS by Tradename, Jun. 16, 2006, 1 page.*
Search on Google, NACCONOL(R) 90G, Jun. 16, 2006, 1 page.*

* cited by examiner

*Primary Examiner*—Nadine Norton
*Assistant Examiner*—Lynette T. Umez-Eronini
(74) *Attorney, Agent, or Firm*—James M. Kasischke; Jean-Paul A. Nasser; Michael P. Stanley

(57) ABSTRACT

Non-chromate solutions for treating and/or etching metals, particularly, aluminum, aluminum alloys, steel and titanium, and method of applying same wherein the solutions include either a titanate or titanium dioxide as a "drop-in replacement" for a chromium-containing compound in a metal surface etching solution that otherwise would contain chromium.

6 Claims, No Drawings

CHROMATE-FREE METHOD FOR SURFACE ETCHING OF STAINLESS STEEL

CROSS REFERENCE TO OTHER PATENT APPLICATIONS

The present application is a division of Ser. No. 10,143,173, U.S. Pat. No. 6,706,207, filed 7 May 2002, issued Mar. 16, 2004.

This patent application is related to co-pending patent applications entitled NON-CHROMATE CONVERSION COATING, U.S. Pat. No. 6,638,369, filed 7 May 2003, CHROMATE-FREE METHOD FOR SURFACE ETCHING OF ALUMINUM AND ALUMINUM ALLOYS Ser. No. 10/679,684, filed on even date with this application, and CHROMATE-FREE METHOD FOR SURFACE ETCHING OF TITANIUM Ser. No. 10/679,682, filed on even date with this application, all these co-pending applications being by the same inventors as this application.

STATEMENT OF GOVERNMENT INTEREST

The invention described herein may be manufactured and used by or for the Government of the United States of America for Governmental purposes without the payment of any royalty thereon or therefor.

BACKGROUND OF THE INVENTION (1) Field of the Invention

The present invention relates to a non-chromate metal surface treating composition for increasing the adhesion of a metal's surface to any one of a group of layers applied thereto, such as corrosion resistant layers, and method of applying same. More particularly, the present invention relates to a metal surface etching solution wherein a chromate, such as sodium dichromate dehydrate, or an oxide of chromium, such as chromium trioxide, is replaced with a titanate, namely sodium metatitanate or an oxide of titanium, namely, titanium dioxide, respectively.

(2) Description of the Prior Art

It is known that solutions containing hexavalent chromium can be used to treat the surface of a metal as etching agents to increase the adhesion of layers which are subsequently applied thereto, such as protective coatings. However, although hexavalent chromium-containing solutions are efficient etching agents, they are also highly toxic and adversely affect the environment and human health. For this reason, many chromate-free solutions for treating metal surfaces have been proposed.

Thus, various non-chromate metal surface treatments, such as disclosed in Tomlinson U.S. Pat. No. 5,759,244, the disclosure of which is incorporated by reference herein, have been disclosed which can increase the adhesion of a metal's surface to a layer subsequently applied thereto. Many of these metal treatments are based on group IV-B metals such as titanium, zirconium and hafnium. For example, U.S. Pat. No. 5,868,872 to Karmaschek et al discloses a chromium-free aqueous bath solution for non-rinse treatment of aluminum and its alloys. The solution comprises zirconium and titanium, orthophosphate, fluoride and a water-soluble or homogeneously water-dispersible organic film former. When applied, the solution is dried on the surface of the aluminum without rinsing. Similarly, U.S. Pat. No. 5,897,716 to Reghi et al discloses a chemically and thermally stable chromate-free aqueous liquid treatment for metals which increases the adhesion of protective layers to the metals' surfaces. The chromate-free aqueous liquid comprises components selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof.

The shortcoming of conventional non-chromate metal surface treatments, such as those described above, is that they cannot be integrated into and employed in place of chromium-containing compounds in current metal treatment solutions which otherwise would contain chromium. As such, conventional non-chromate metal surface treatments are usually so different from previously employed chromate-containing metal surface treatments that significant changes are required to be made in the metal treating process and in the production of the metal surface treatment itself. These changes can amount substantial expenditures and usually require additional approval from Department of the Navy. Thus, there is a need for "drop-in replacements" that can be employed in place of chromium-containing compounds, such as sodium dichromate, now used in conventional chromate-containing metal treatment solutions. "Drop-in replacement" refers to a compound that can be employed in a metal surface treatment solution in lieu of a chromium-containing compound without requiring any or substantial changes in the make-up of the metal surface treatment process or metal surface treatment solution.

SUMMARY OF THE INVENTION

It is a primary object of the invention to provide a non-chromate metal surface treatment solution for increasing the adhesion of a layer, such as a corrosion resistant layer, to a metal's surface wherein the solution contains a titanate or titanium dioxide in place of a chromium-containing compound.

It is a further primary object of the invention to provide a "drop-in replacement" for a chromium-containing compound that can be employed in a metal surface treatment solution which otherwise would include chromium.

Another object of the invention is to provide a method of increasing the adhesion of a metal's surface to a layer, such as a protective or corrosion resistant layer, applied thereto.

The objects of the invention are accomplished by providing a highly effective, non-chromate metal surface treatment solution which includes a titanate, such as sodium metatitanate or potassium titanate, or titanium dioxide in lieu of a chromium-containing compound in a metal surface treatment solution that otherwise would include chromium. More particularly, the invention relates to a non-chromate metal surface etching solution for etching metals, specifically, aluminum, aluminum alloys, stainless steel, titanium and titanium alloys, to increase the adhesion properties of a particular metal's surface.

The present invention is developed on the basis of findings that the adhesion of a layer or coating, such as corrosion resistant coating, to a metal's surface can be increased by bathing a metal substrate in an aqueous solution which contains a chromium-containing compound. Specifically, for example, it is known that a solution containing distilled or deionized water, sulfuric acid, seed aluminum and sodium dichromate dihydrate creates a superb etching solution for aluminum and aluminum alloys. It is further known that a solution containing chromium trioxide and deionized water creates a superb etching solution for stainless steel and titanium. It is believed that the chromium-containing compound in each of the foregoing etching solutions provides increased adhesion to the respective metal surface by providing a contact surface chemistry and allowing for ionic bonding.

Test results show that a metal tested without being treated with an etching solution has poor durability and weak boundry layer. For example, untreated aluminum has weak boundry layer and weak oxides; untreated stainless steel has controlled surface properties; and untreated titanium has controlled surface properties. However, since personal exposure limits (PEL) for chromates is 0.1 mg/m$^3$ (milligram per cubic meter), chromate-containing etching solutions are not practical for use. Thus, "drop-in replacements" for chromium-containing compounds are needed for etching solutions that otherwise would contain chromium.

Sodium metatitanate, potassium titanate and titanium dioxide have been found to be well-suited as "drop-in replacements" for chromium-containing compounds in conventional metal surface etching solutions which typically include, in addition to sodium dichromate, potassium dichromate or chromium trioxide, various other less toxic or non-toxic components. The PEL of the titanium compounds is 15 mg/m$^3$, and thus, the solutions provide highly effective, non-toxic, metal alternatives to solutions which otherwise would include chromium-containing compounds.

DESCRIPTION OF THE PREFERRED EMBODIMENT

The present invention will hereafter be described in detail with reference to the following embodiments.

The preferred embodiments of the present invention are non-chromate metal surface etching solutions for aluminum, aluminum alloys, steel and titanium which include a titanate or titanium dioxide in place of a chromium-containing compound in a metal surface etching solution that otherwise would include chromium. For example, it is known that a solution containing 1 liter of distilled or deionized water, 300 grams of sulfuric acid, 60 grams of sodium dichromate dehydrate and 1.5 grams of seed aluminum provides an excellent aluminum and aluminum alloy etching solution. However, as explained above, such chromate containing solutions pose serious health risks.

It has now been found that sodium dichromate dihydrate present in the foregoing conventional aluminum and aluminum alloy etching solution can be replaced with sodium metatitanate or potassium titanate without having to alter the various other non-chromate constituents therein or the method of employing the solution. Thus, an etching solution for aluminum and aluminum alloys that otherwise would contain sodium dichromate dihydrate, a highly toxic compound, can be rendered non-toxic.

In such cases, the aluminum or aluminum alloy to be etched is first bathed in an etching solution comprising distilled or deionized water in an amount ranging about 0.5 liter (L) to 1.5 L, sulfuric acid in an amount ranging from about 150 grams (g) to 450 g, sodium metatitanate or potassium titanate in an amount ranging from about 10 g to about 150 g and bare aluminum in an amount ranging from about 0 g to about 5 g. The aluminum or aluminum alloy is immersed in the bath from about 5 minutes to about 20 minutes while the etching solution is maintained at a temperature of about 120° F. to about 180° F. Immediately after removing the aluminum or aluminum alloy from the bath, it is rinsed by spraying it with tap water for about 5 minutes. This is contrary to prior art methods for applying chromium-free solution wherein the solution typically is not rinsed from the metal but rather is allowed to dry thereon forming a polymer layer. Thereafter, the aluminum or aluminum alloy is soaked in deionized water and then dried at a temperature of about 120° F. to about 140° F. Bonding layers to the metal substrate is performed within about 16 hours of drying.

Similarly, it has been found that titanium dioxide can replace chromium trioxide in a metal surface etching solution for stainless steel and titanium which otherwise typically includes 1 part by weight (pbw) chromium trioxide and 4 pbw deionized water. More particularly, etching stainless steel typically requires two baths which include two different solutions. For example, a pretreatment bath or first bath for stainless steel which includes a solution of 2.5 pbw sodium metasilicate, 1.1 pbw tetrasodium pyrophosphate, 1.1 pbw sodium hydroxide, 0.3 pbw nacconol and 95 pbw deionized water is required to clean the stainless steel. A second bath is further required which includes an etching solution containing 1 pwb of chromium trioxide and 4 pbw of deionized water. The present invention provides a "drop-in replacement" for chromium trioxide in the foregoing steel and titanium etching solution.

Therefore, according to the present invention, stainless steel to be etched is first immersed in a pretreatment bath including sodium metasilicate in an amount ranging from about 1 pbw to 5 pbw, tetrasodium pyrophosphate in an amount ranging from about 1 pbw to 4 pbw, sodium hydroxide in an amount ranging from about 0.5 pbw to 2.0 pbw, NACCONOL®(linear alkyl benzene sulfonate) in an amount ranging from about 0.1 pbw to 1.0 pbw and deionized water in an amount ranging from about 90 pbw to 95 pbw. The steel is immersed in the pretreatment solution for about 5 minutes to 15 minutes while the solution is maintained at a temperature of about 120° F. to about 180° F. Thereafter, the steel is rinsed throughly in water before being immersed in a second bath or etching bath which includes titanium dioxide in an amount ranging from about 0.5 pbw to about 6 pbw and deionized water in an amount ranging from about 2 pbw to about 10 pbw. The steel is immersed in the etching bath from about 10 minutes while the etching solution is maintained at a temperature of about 140° F. to about 190° F. The stainless steel is then washed in cold running deionized water and dried in a forced-draft oven at less than 140° F. Thus, like the etching solution for aluminum and aluminum alloys described above, the etching solution of the present invention for steel is not dried thereon thereby forming a polymer layer on the surface of the steel. Bonding to the stainless steel's surface is best performed as soon as the metal's surface cools.

Etching titanium also requires that the metal be bathed in two baths that include two different solutions. Typically, a first bath containing 400 ml (milliliter) of 38% hydrochloric acid, 40 ml of 85% phosphoric acid and 20 ml of 52% hydrofluoric acid is required to clean and etch the surface to the titanium. Thereafter, a second bath is employed which contains an etching solution comprising 1 pbw chromium trioxide and 4 pbw deionized water.

Therefore, according to the present invention, titanium to be etched is first immersed in a first bath including a solution comprising about 350 ml to about 450 ml of a 38% solution of hydrochloric acid, about 35 ml to about 45 ml of a 85% solution of phosphoric acid and about 10 ml to about 30 ml of a 52% solution of hydroflouric acid. Thereafter, it is immersed in a second bath or an etching bath, like the bath for stainless steel, which includes titanium dioxide in an amount ranging from about 0.5 pbw to about 6 pbw and deionized water in an amount ranging from about 2 pbw to about 10 pbw.

More particularly, titanium to be etched employing the foregoing solutions is first cleaned with a cloth wetted with trichloroethane in order to degrease the surface. It is preferred that wiping occurs in one direction only. This serves to remove dirt. Thereafter, the titanium is immersed in the first bath or pretreatment bath for about 5 minutes to about 15 minutes at a temperature of about 120° F. to about 180° F. The titanium is then rinsed thoroughly in water before being immersed in the second bath or etching bath from about 5 minutes to about 20 minutes at a temperature of about 120° F. to about 180° F. Thereafter, the titanium is washed in cold running deionized water before being dried in a forced-draft oven at 225±25° F. for 1 hour. Again, the etching solution is not dried on the surface of the metal. The bonding surfaces of the titanium are primed within about 4 hours of etching.

While the preferred embodiment of the non-chromate metal treatment solution and method of applying same has been described in detail above, various modifications and variations of the invention are possible in light of the above teaching. As an example, the composition of the surface treatment mixtures and the duration of treatments of various surfaces can be varied without deviating from the scope of the invention. It is therefore understood that within the scope of the appended claims the invention may be practiced otherwise and above described.

What is claimed is:

1. A method of etching stainless steel comprising:

immersing the steel in a first bath comprising sodium metasilicate, tetrasodium pyrophosphate, sodium hydroxide, linear alkyl benzene sulfonate and deionized water; and immersing the stainless steel in a second bath comprising titanium dioxide and deionized water.

2. The method in accordance with claim 1 wherein the second bath comprises titanium dioxide in an amount ranging from about 0.5 pbw to about 6 pbw and deionized water in an amount ranging from about 2 pbw to about 10 pbw.

3. The method in accordance with claim 2 wherein the first bath comprises sodium metasilicate in an amount ranging from about 1 pbw to about 5 pbw, tetrasodium pyrophosphate in an amount ranging from about 1 pbw to about 4 pbw, sodium hydroxide in an amount ranging from about 0.5 pbw to about 2.0 pbw, linear alkyl benzene sulfonate in an amount ranging from about 0.1 pbw to about 1.0 pbw and deionized water in an amount ranging from about 90 pbw to about 95 pbw.

4. The method in accordance with claim 3 further comprising rinsing the steel in deionized water after immersing the steel in the second bath.

5. The method in accordance with claim 4 wherein the second bath is maintained at a temperature ranging from about 140° F. to about 190° F.

6. The method in accordance to claim 4 wherein the steel is dried in an oven having a temperature less than about 140° F.

* * * * *